US006076295A

United States Patent [19]

Garfinkle

[11] Patent Number: 6,076,295

[45] **Date of Patent: *Jun. 20, 2000**

[54] MODULAR SIGN SYSTEM

[76] Inventor: Benjamin L. Garfinkle, 1120 Portal Ave., Piedmont, Calif.

[ * ] Notice: This patent is subject to a terminal disclaimer.

[21] Appl. No.: 08/846,385

[22] Filed: Apr. 30, 1997

Related U.S. Application Data

[63] Continuation-in-part of application No. 08/558,255, Nov. 17, 1995, Pat. No. 5,666,751, which is a continuation of application No. 07/937,521, Aug. 27, 1992, abandoned.

[51] Int. Cl.[7] ..... G09F 7/18

[52] U.S. Cl. ..... 40/605; 40/611; 40/617

[58] Field of Search ..... 40/605, 606, 611, 40/617, 618, 620, 622, 649, 651, 657, 734, 780, 124; 52/38, 690, 786.11, 783.18, 790.1, 793.11

[56] References Cited

U.S. PATENT DOCUMENTS

| | | | |
|---|---|---|---|
| 2,505,673 | 4/1950 | Howenstine | 52/793.11 X |
| 3,154,870 | 11/1964 | Hopp et al. | 40/605 |
| 4,166,332 | 9/1979 | Donovan | 40/606 X |
| 4,593,486 | 6/1986 | Visocky et al. | 40/649 X |
| 4,630,386 | 12/1986 | Wilson | 40/734 |
| 4,726,133 | 2/1988 | Rainone et al. | 40/780 |
| 5,090,145 | 2/1992 | Chiang et al. | 40/605 |
| 5,099,589 | 3/1992 | Lai | 40/746 |
| 5,666,751 | 9/1997 | Garfinkle | 40/605 |

FOREIGN PATENT DOCUMENTS

| | | | |
|---|---|---|---|
| 3821870 | 12/1988 | Germany | 40/606 |

*Primary Examiner*—Brian K. Green
*Attorney, Agent, or Firm*—Malcom B. Wittenberg

[57] ABSTRACT

A kit of parts and assembly of parts configured to create a sign system frame for accepting and displaying flexible signage of substantially uniform vertical dimension. One or more substantially uniformly parallel pairs of rail sections are provided each having an outer edge and inner edge. The rail sections have substantially uniform cross sections and longitudinal axes wherein the inner edge of the rail sections are provided with separator slots and signage slots for accepting and frictionally retaining the flexible signage and separator panels. The separator panels are employed to maintain pairs of rail sections parallel to one another at a distance approximating the uniform vertical dimension of the signage.

24 Claims, 4 Drawing Sheets

MODULAR SIGN SYSTEM

This is a continuation-in-part of application Ser. No. 08/558,255. filed Nov. 17, 1995 now U.S. Pat. No. 5,666, 751, which is a continuation of U.S. application Ser. No. 07/937,521 filed Aug. 27, 1992, now abandoned.

TECHNICAL FIELD OF THE INVENTION

The present invention relates to signs and sign systems particularly those employed in supermarket, drugstore and like environments.

BACKGROUND OF THE INVENTION

Supermarkets, drugstores and similar shopping areas such as the increasingly popular discount warehouse-like shops present unique signage display problems. These unique problems are the result of the necessity to display widely diverse consumer-related products which do not lend themselves to the use of a single signage system. Particularly in discount warehouse-like shopping environments, it is also commonplace to hang signage from a ceiling-like structure in order to attract the even casual shopper to a specific display or sales area.

In the past, retail and wholesale shopping facilities were required to inventory different sign systems depending upon whether the signage was to be hung from a ceiling or supported by a floor standing display such as an easel base support. In addition, prior signage systems were difficult to assemble in the field and, once assembled, were difficult to break down for storage or reassembly in a different storage location. Finally, completely different sign systems were required for signage of different dimension. There continues to be an obvious need to provide signage of various dimensions depending upon the orientation required to promote a given display.

It is thus an object of the present invention to provide a signage system capable of being employed within a supermarket or like environment, universally, with minor modification from service area to service area.

It is a further object of the present invention to provide a universally acceptable signage system which can easily be assembled in the field of a snap-fit design which can accommodate signage of varying sizes and which can be broken down and stored conveniently.

These and further objects of the present invention will be more readily appreciated when considering the following description and appended claims.

SUMMARY OF THE INVENTION

The present invention involves a sign system frame for accepting and displaying flexible signage. Signage is generally provided as planar sheet material having a substantially uniform vertical dimension. The frame is comprised of one or more substantially uniformly parallel pairs of rail sections each having an outer edge and inner edge. The rail sections are provided with substantially uniform cross sections and longitudinal axes.

As a first embodiment, at least one of the rail sections discussed above is provided with an open region at its outer edge for accepting connector means. The connector means are provided for connecting the frame to support means. As a second embodiment, connector means are employed which do not rely upon the creation of an open region at the outer edge of rail sections. In either case, the rail sections are also provided, at their inner edges with separator slot means and signage slot means. The signage slot means is provided for accepting and frictionally retaining flexible signage while one or more separator panels are provided for frictionally engaging the separator slot means. By use of said separator slot means, rail sections are maintained in parallel pairs at distances approximating the uniform vertical dimension of the flexible signage.

DETAILED DESCRIPTION OF THE INVENTION

Figure 1:
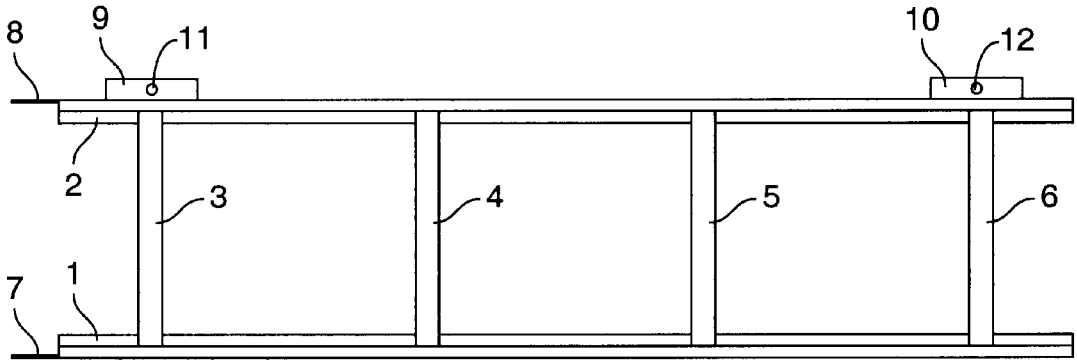
FIG. 1 is an elevation view of the sign system of the present invention.
Figure 2:
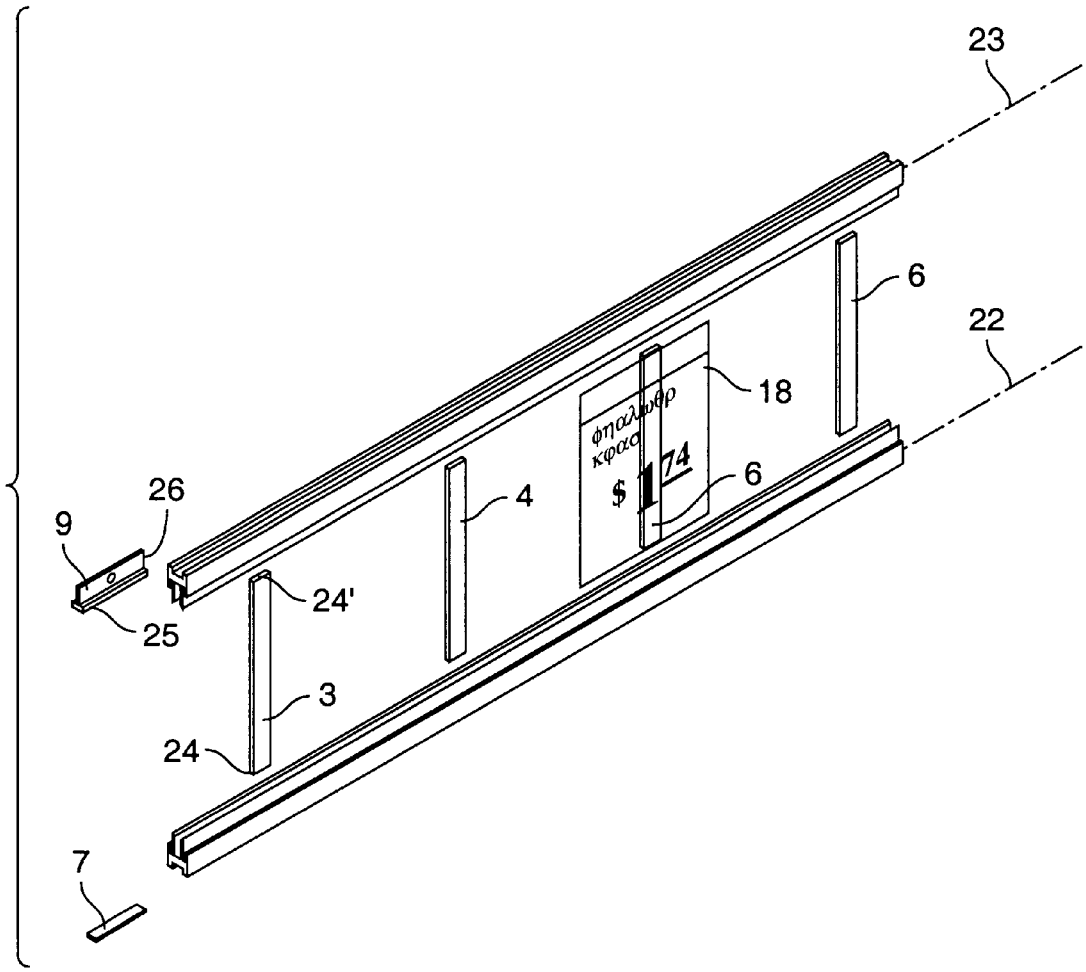
FIG. 2 is an exploded view of the sign system of FIG. 1.

The sign system of the present invention can best be visualized by referencing FIGS. 1 and 2. It is the object of the present invention to display signage such as that shown in phantom as element 18 (FIG. 2). Such signage is provided with a substantially uniform vertical dimension most commonly in the form of a square or rectangle having parallel, vertical and horizontal edges. It is thus the intent of the signage shown in FIGS. 1 and 2 to display the availability of instant rice at $1.79 for an 8 ounce package, the signage hanging from a ceiling or similar structure presumably over a display of said rice packaging.

Figure 3:
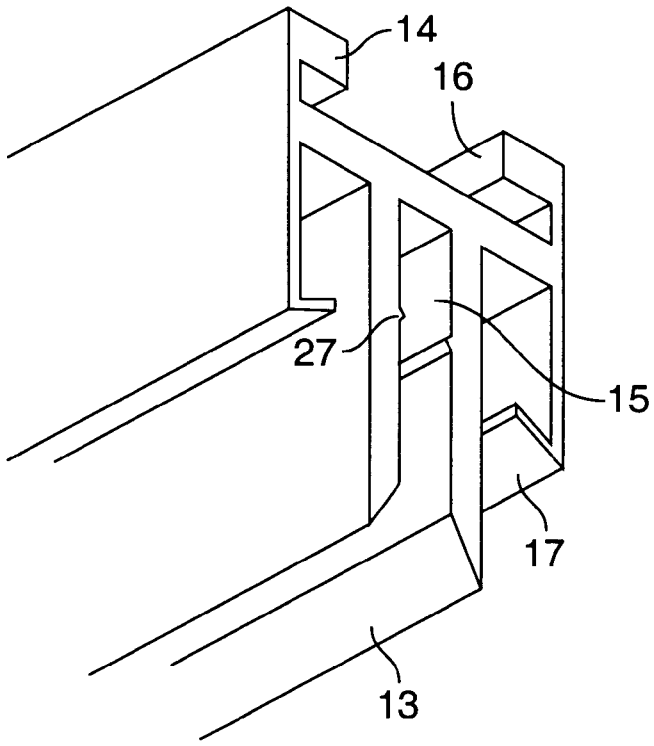
FIG. 3 is a perspective view of a typical rail section and cross section produced pursuant to the present invention.

The frame comprises parallel pairs 1 and 2 of rail sections each having an outer edge 14 and inner edge 13 noting that the rail sections have a substantially uniform cross section as best seen in FIG. 3 and coextensive longitudinal axes 22 and 23.

At inner edge 13 is provided separator slot means 15. Separator slot means 15 optionally having barbs 27 is configured within rail sections to receive and accommodate separator panels 3, 4, 5 and 6 which frictionally engage and separate rails 1 and 2 to maintain the rail pairs parallel to one another at a distance approximating the vertical dimension of signage 18. Ideally, the various separator panels are provided with detent regions 24 and 24' of reduced cross section for frictionally engaging separator slot means 15.

The various separator panels are frictionally and removably engaged with parallel rail sections 1 and 2. Specifically, the spacing between separator panels can be easily adjusted while the longitudinal length of each separator panel can be altered to change the vertical distance between adjacent rail sections 1 and 2. In this way, signage of different vertical dimensions can be accommodated by simply inventorying separator panels of the appropriate dimension. As such, merchandisers need not maintain and inventory separate sign systems to accommodate signage of different sizes. Only a single set of rails need be maintained and panel sections of varying height inventoried. Such a systems approach to the present sign system invention greatly facilitates its universal application.

System flexibility is further enhanced when considering the various connector means options which are available.

Specifically, in a first embodiment, open region 16 is provided at rail outer edge 14 for accepting connector means for connecting the frame to an appropriate support means. In viewing FIGS. 1 and 2 a first embodiment is depicted whereby connector means 9 is shown in the form of a hanger which consists of a longitudinally extending element of substantially uniform cross section having a base leg 25 and perpendicularly extending transverse leg 26. The base leg is sized to slidably fit within and be received by open region 16. As such, connector means 9 can be slidably accommodated across rail 2 in order to position the sign system directly beneath an appropriate hanger element general emanating from the ceiling or from a beam support structure within the supermarket or like facility. In this regard, hanger element 9 is provided with opening 11 for accepting and retaining a hanger wire (not shown) for hanging the sign system vertically beneath a suitable support.

Figure 4:
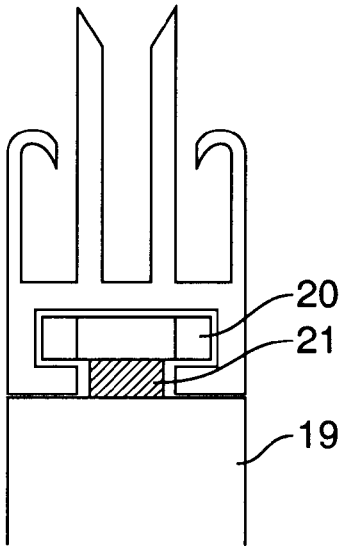
FIG. 4 depicts, in detail, an embodiment for attaching the rail section of FIG. 3 to a suitable support.

An alternative embodiment is shown in FIG. 4 wherein in this embodiment a threaded male member 21 and threaded female member 20 are provided. Threaded female member 20 can be slid within the T-shaped profile of open region 16 and threaded male member 21 screwably connected thereto in order to support the sign system from a table, flooring or similar structure via connecting rod 19. For example, the sign system can be supported by an easel base (not shown) located on a tabletop and surrounded by produce such as a pyramid of grapefruit, oranges or lemons. The weight of the produce would support the easel base and maintain the sign system in its predetermined location. Furthermore, once threaded female member 20 has been positioned appropriately, by tightening male member 21 therein, the assembly can be fixed in position so that the elements are no longer slidable within open region 16.

Figure 5A:
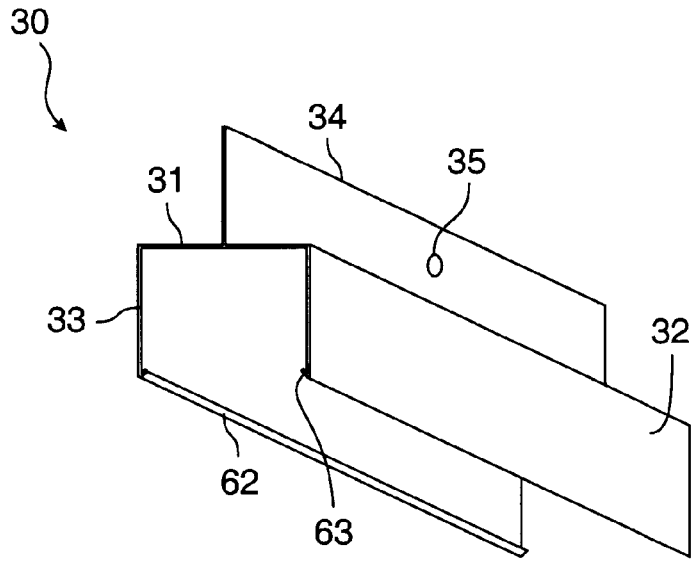
FIGS. 5*a* through *c* depict in both perspective and end views a second embodiment of the present invention of an alternative means for attaching one of the pair of rail sections to a support means.
Figure 5B:
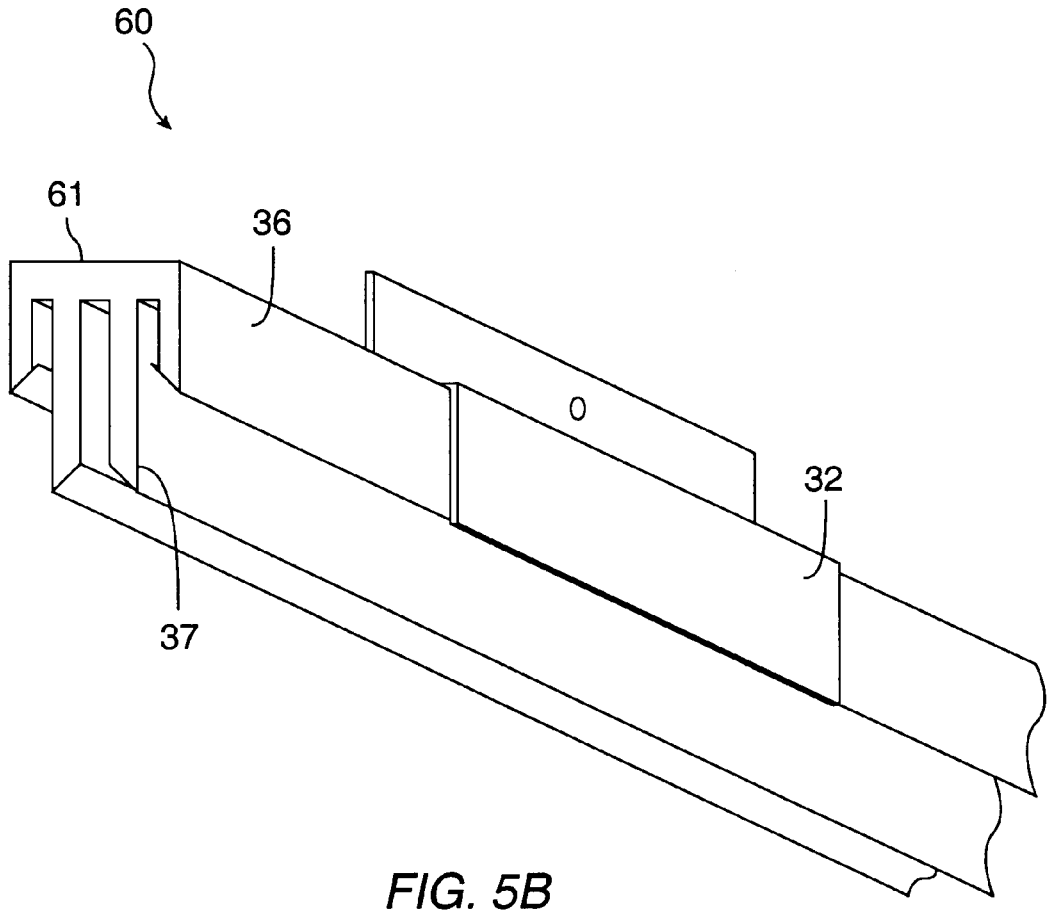
Figure 5C:
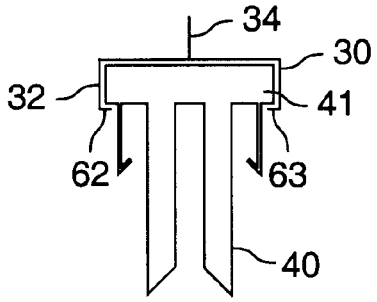

A second embodiment of the present invention can be appreciated by viewing FIGS. 5*a* through *c* which display an alternative means of connecting one of the pair of rail sections to a suitable support means. Note that this alternative embodiment does not reply upon the rail sections as having an open region at its outer edge. Instead, rail section 60 has a closed outer edge 61 whereupon connector means 30 comprised of base 31 and legs 32 and 33 extending approximately perpendicular thereto is sized to frictionally engage rail 60 capturing edge 61. Connector means 30 can also be provided with plate 34 connected to and extending substantially perpendicular from base 31. Plate 34 can further include hole 35 for accepting support means (not shown) therethrough for supporting rail section 60.

As yet a further preferred embodiment, connector means 30 can be provided with indents 62 and 63 upon legs 33 and 32, respectively. These detents can extend into indents upon ridge 36 so that the connector means can snap fit onto ridge 36 of rail section 60. Noting that rail section 60 provides signage slot means by inner and outer ridges 36 and 37 spaced apart from one another, connector means 30 can further snap fit onto rail section 60 by extending legs 32 and 33 such that indents 62 and 63 extend over and capture the above-noted ridges 36. This configuration is further shown as an alternative in FIG. 5*c* wherein ridges 62 and 63 of legs 32 and 33 are shown to pass over and capture region 41 which is, in turn, akin to outer edge 61 (FIG. 5*b*). Although rail section 40 is of slightly different cross-section as compared to rail section 60, the function of connector means 30 is the same, that is, the connector means operates as an element to capture the upper edge of the rail section and frictionally engage it so that the rail section can be attached to a suitable attachment means.

It is further noted that signage 18 in fitting within signage slot means 17 can not only be easily removed from the sign system of the present invention but can also slide along the various rail members in order to position the signage in proximity to the merchandise being displayed. The sign system can also accommodate multiple sign elements in adjacent positions the limitation only being the length of the rails themselves when considered with respect to the width of the aggregate signage members.

Figure 6:
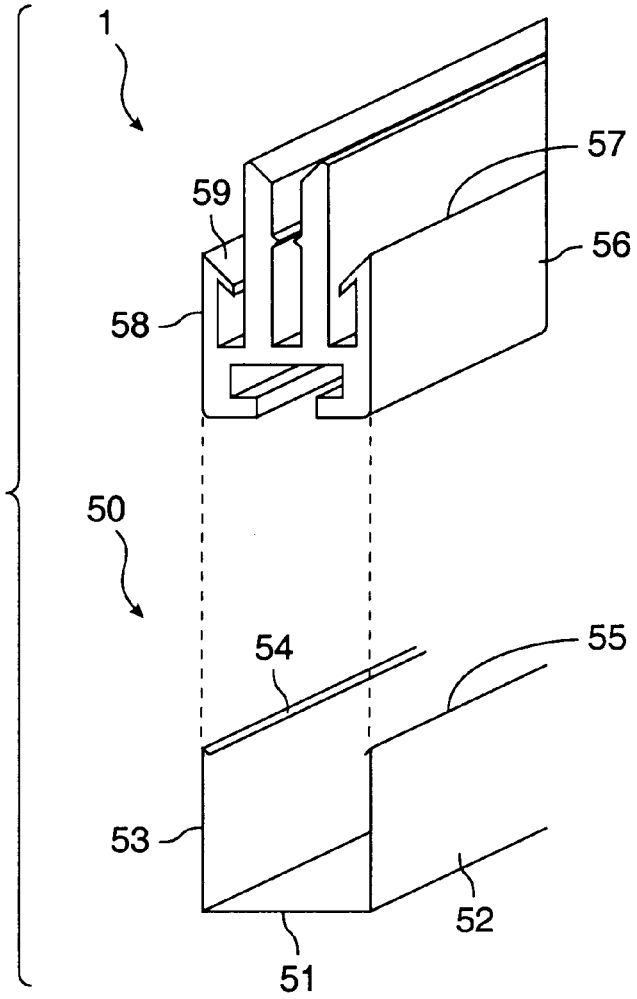
FIG. 6 depicts an alternative splicer bar for capturing outer edges of adjacent rail sections.

The sign system of the present invention can be horizontally extended virtually indefinitely through the use of splicer bars. In a first embodiment, the splicer bars 7 and 8 comprise longitudinally extending elements of substantially uniform cross section for frictionally engaging open regions 16 of adjacent rail sections. As shown, approximately half of each splicer bar is frictionally inserted into terminal ends of adjacent rail sections to provide for continuous rails along longitudinal axes 22 and 23. As such, the merchandiser can maintain an inventory of rail sections standard in length and need not be concerned with the need to inventory varying lengths of fixed sign supports as was required by the prior art. Therefore, enhanced flexibility is achievable by such a systems approach to the present signage invention. As an alternative embodiment, reference is made to FIG. 6 whereby splicer 50 is shown as comprising a base 51 and legs 52 and 53 with, preferably, indents 54 and 55 extending from the extremities of said legs. In operation, splicer 50 can pass over and capture rail section 1 whereby legs 52 and 53 extend over ridges 56 and 58 whereby indents 54 and 55 contact edges 57 and 59 as shown. In using splicer 50, it makes no difference whether one employs rail 1 with an open region as shown in FIG. 6 or rail sections 40 or 60 shown in FIGS. 5*c* and 5*b*, respectively, as splicer 50 does not depend upon an open region for its utility.

What is claimed is:

1. A kit of parts for constructing a sign system, said sign system configured for accepting and displaying flexible signage, said kit of parts consisting essentially of:

(a) flexible signage of substantially uniform vertical dimension;

(b) two or more separator panels;

(c) connector for connecting said sign system to a support; and (d) at least one pair of rail sections wherein each said rail section has:

1) an outer edge;

2) an inner edge;

3) substantially uniform cross section;

4) a longitudinal axis;

5) a signage slot at the inner edge for accepting and frictionally retaining said flexible signage;

6) a separator slot at the inner edge for frictionally engaging said two or more separator panels so that said two or more separator panels are positionable anywhere along said rail sections within said separator slot and when installed together with said flexible signage reside behind said signage wherein only said two or more separator panels maintain said rail sections as parallel pairs; and wherein at least one of said rail sections is provided with an open region at its outer edge for accepting and retaining said connector.

2. The kit of parts of claim 1 wherein said connector comprises a longitudinally extending element of substantially uniform cross section having a base leg and perpendicularly extending transverse leg, said base leg being slidably received by said open region and said transverse leg being attachable to said support.

3. The kit of parts of claim 2 wherein said transverse leg is provided with an opening for hanging said sign system from a ceiling structure.

4. The kit of parts of claim 1 wherein said connector comprises a threaded male member and threaded female member, said threaded female member being slidably received within said open region.

5. The kit of parts of claim 4 wherein said connector engages said rail section by screwing said male member into said female member and tightening said male and female members whereupon said female member is no longer slidable within said open region.

6. The kit of parts of claim 1 wherein said open region is substantially T-shaped in cross section.

7. The kit of parts of claim 1 wherein said two or more separator panels are substantially of uniform length and are employed substantially evenly spaced along said rail sections in a substantially vertical orientation to maintain said rail sections in a substantially horizontal orientation.

8. The kit of parts of claim 7 wherein said two or more separator panels are provided with detent regions of reduced cross section and said slot provided with barbs for frictionally engaging and retaining said separator slot means.

9. An assembly of parts in the form of a sign system, said sign system configured for accepting and displaying flexible signage, said assembly of parts consisting essentially of:

(a) flexible signage of substantially uniform vertical dimension;

(b) two or more separator panels;

(c) a connector for connecting said sign system to a support; and (d) at least one pair of rail sections wherein each said rail section has:

1) an outer edge;

2) an inner edge;

3) substantially uniform cross section;

4) a longitudinal axis;

5) a signage slot at the inner edge for accepting and frictionally retaining said flexible signage;

6) a separator slot at the inner edge for frictionally engaging said two or more separator panels so that said two or more separator panels are positionable anywhere along said rail sections within said separator slot and when installed together with said flexible signage reside behind said signage wherein only said two or more separator panels maintain said rail sections as parallel pairs; and wherein at least one of said rail sections is provided with an open region at its outer edge for accepting and retaining said connector.

10. The assembly of parts of claim 9 wherein said connector comprises a longitudinally extending element of substantially uniform cross section having a base leg and perpendicularly extending transverse leg, said base leg being slidably received by said open region and said transverse leg being attachable to said support.

11. The assembly of parts of claim 10 wherein said transverse leg is provided with an opening for hanging said sign system from a ceiling structure.

12. The assembly of parts of claim 9 wherein said connector comprises a threaded male member and threaded female member, said threaded female member being slidably received within said open region.

13. The assembly of parts of claim 12 wherein said connector engages said rail section by screwing said male member into said female member and tightening said male and female members whereupon said female member is no longer slidable within said open region.

14. The assembly of parts of claim 9 wherein said open region is substantially T-shaped in cross section.

15. The assembly of parts of claim 9 wherein said two or more separator panels are substantially of uniform length and are employed substantially evenly spaced along said rail sections in a substantially vertical orientation to maintain said rail sections in a substantially horizontal orientation.

16. The assembly of parts of claim 15 wherein said one or more separator panels are provided with detent regions of reduced cross section and said slot provided with barbs for frictionally engaging and retaining said separator slot.

17. A kit of parts for constructing a sign system, said sign system configured for accepting and displaying flexible signage, said kit of parts consisting essentially of:

(a) flexible signage of substantially uniform vertical dimension;

(b) two or more separator panels;

(c) at least one pair of rail sections wherein each said rail section has:

1) an outer edge;

2) an inner edge;

3) substantially uniform cross section;

4) a longitudinal axis;

5) a signage slot at the inner edge for accepting and frictionally retaining said flexible signage;

6) a separator slot at the inner edge for frictionally engaging said two or more separator panels so that said two or more separator panels are positionable anywhere along said rail sections within said separator slot and when installed together with said flexible signage reside behind said signage wherein only said two or more separator panels maintain said rail sections as parallel pairs; and (d) a connector for frictionally and releasably engaging one of said pair of rail sections to a support.

18. The kit of parts of claim 17 wherein said connector is characterized as having a base and a pair of legs, said legs being substantially perpendicular to said base wherein said base and legs being sized to fit over and frictionally capture the outer edge of said one of said pair of rail sections.

19. The kit of parts of claim 18 wherein said pair of legs of said connector is provided with detents and said one of said pair of rail sections is provided with indents such that when said connector is installed upon said one of said pair of rail sections, said detents engage said indents.

20. The kit of parts of claim 18 wherein said signage slot comprises inner and outer ridges spaced apart from one another to form a slot for accepting signage and wherein said connector is configured such that said legs are sized to extend over and capture said outer ridges.

21. The kit of parts of claim 18 wherein said connector further comprises a plate connected to and extending substantially perpendicular from said base.

22. The kit of parts of claim 21 wherein said plate further includes a hole for accepting support therethrough for supporting said at least one of said pair of rail sections.

23. The kit of parts of claim 17 wherein said two or more separator panels are substantially of uniform length and are employed substantially evenly spaced along said rail sections in a substantially vertical orientation to maintain said rail sections in a substantially horizontal orientation.

24. The kit of parts of claim 23 wherein said two or more separator panels are provided with detent regions of reduced cross section and said slot provided with barbs for frictionally engaging and retaining said separator slot.

* * * * *